US006480156B2

(12) United States Patent
Tsai et al.

(10) Patent No.: US 6,480,156 B2
(45) Date of Patent: Nov. 12, 2002

(54) INVERTED-F DIPOLE ANTENNA

(75) Inventors: Szu-Nan Tsai, Tu-Chen (TW); Hsiang-Hui Shen, Tu-Chen (TW); Hsin Kuo Dai, Tu-Chen (TW); Kun Te Cheng, Tu-Chen (TW); Hsien Chu Lin, Tu-Chen (TW); Chieh Chao Yu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/819,455

(22) Filed: Mar. 27, 2001

(65) Prior Publication Data

US 2002/0140613 A1 Oct. 3, 2002

(30) Foreign Application Priority Data

Mar. 9, 2001 (CN) ..... 090105621

(51) Int. Cl.[7] ..... H01Q 1/24
(52) U.S. Cl. ..... 343/700 MS; 343/702
(58) Field of Search ..... 343/700 MS, 702, 343/735, 736, 805, 806, 808, 809

(56) References Cited

U.S. PATENT DOCUMENTS 2,929,063 A * 3/1960 Lynn, Jr. ..... 343/731
3,683,376 A * 8/1972 Pronovost ..... 343/5 PD
5,793,336 A * 8/1998 Shoemaker et al. ..... 343/795
5,966,098 A * 10/1999 Qi et al. ..... 343/702

* cited by examiner

*Primary Examiner*—Don Wong
*Assistant Examiner*—James Clinger
(74) *Attorney, Agent, or Firm*—Wei Te Chung

(57) ABSTRACT

An inverted-F dipole antenna (1) for an electronic device includes a conductive antenna body (12), an antenna base (11), a connector (14) providing an electrical interface to an RF circuitry, and a cable (13) connecting the antenna body to the connector. The antenna body includes a first and second arms (121), (122) and a U-shaped portion (123) connecting the first and second arms. The antenna base includes an insulative board (111) and a metal sheet (112) attached to one surface of the board. The U-shaped portion of the antenna body is attached to a second surface of the board opposite to the metal sheet. The first arm serves as a radiation device.

10 Claims, 7 Drawing Sheets

| FREQ (GHz) | VSWR |
|---|---|
| Mkr1:2.4000000 | 1.609 |
| Mkr1:2.4500000 | 1.520 |
| Mkr1:2.5000000 | 1.111 |

INVERTED-F DIPOLE ANTENNA

FIELD OF THE INVENTION

The present invention relates to an antenna, and particularly to an inverted-F dipole antenna mounted in an electronic device and operating in the ISM (Industry, Science, Medicine) frequency band for communicating with various electronic devices.

BACKGROUND OF THE INVENTION

FIG. 7 illustrates a conventional planar inverted-F antenna (PIFA). The PIFA 10 includes a ground plane 12, an $L_P \times W_P$ rectangular radiating patch 14 and a short-circuit plate 16 having a width $d_1$ which is narrower than the width $W_p$ of the radiating patch 14. The short-circuit plate 16 shorts the radiating patch 14 to the ground plane 12 along a null of the $TM_{100}$ dominant mode electric field of the radiating patch 14. The PIFA 10 may thus be considered a rectangular microstrip antenna in which the length of the rectangular radiating patch 14 is reduced by half by the connection of the short-circuit plate 16 at the $TM_{100}$ dominant mode null. The short-circuit plate 16 supports the radiating patch 14 at a distance d2 above the ground plane 12. The radiating patch 14 is fed by a TEM transmission line 18 from the back of the ground plane 12, at a point located a distance $d_3$ from the short-circuit plate 16. The transmission line 18 has a width $d_4$ and includes an inner conductor 20 surrounded by an outer conductor 22. The PIFA 10 is suited for use in personal base stations, handsets and other wireless communication terminals because it has a large bandwidth and can be implemented using an air dielectric as shown in FIG. 7.

However, in this design, the inner conductor 20 of the TEM transmission line 18 penetrates through the ground plane 12 and connects with the radiating patch 14 and the outer conductor 22 connects with the ground plane 12. This design makes the assembly more complicated and increases the cost of the antenna. Furthermore, the antenna occupies a large space, so it goes against the trend toward miniaturization of electronic devices.

The present invention is directed to solving the above problems and satisfying the need for a simple antenna of the character described.

BRIEF SUMMARY OF THE INVENTION

A primary object, therefore, of the present invention is to provide an improved antenna which occupies a small space and has a simplified manufacture.

In order to achieve the objects set forth, an inverted-F dipole antenna in accordance with the present invention comprises an antenna body, an antenna base, a connector providing an electrical interface to an RF circuitry and a cable connecting the antenna body with the connector. The antenna body includes two metal arms and a bended wire connecting the two arms. The antenna base includes a rectangular insulative board and a metal sheet attached to one surface of the board. The antenna body is mounted on the antenna base with the bended wire thereof being attached to a second surface of the board opposite to the metal sheet. The cable serves as a RF feeder and one of the metal arms serves as a radiation device.

Other objects, advantages and novel features of the invention will become more apparent from the following detailed description when taken in conjunction with the accompanying drawings.

DETAILED DESCRIPTION OF THE INVENTION

Figure 1:
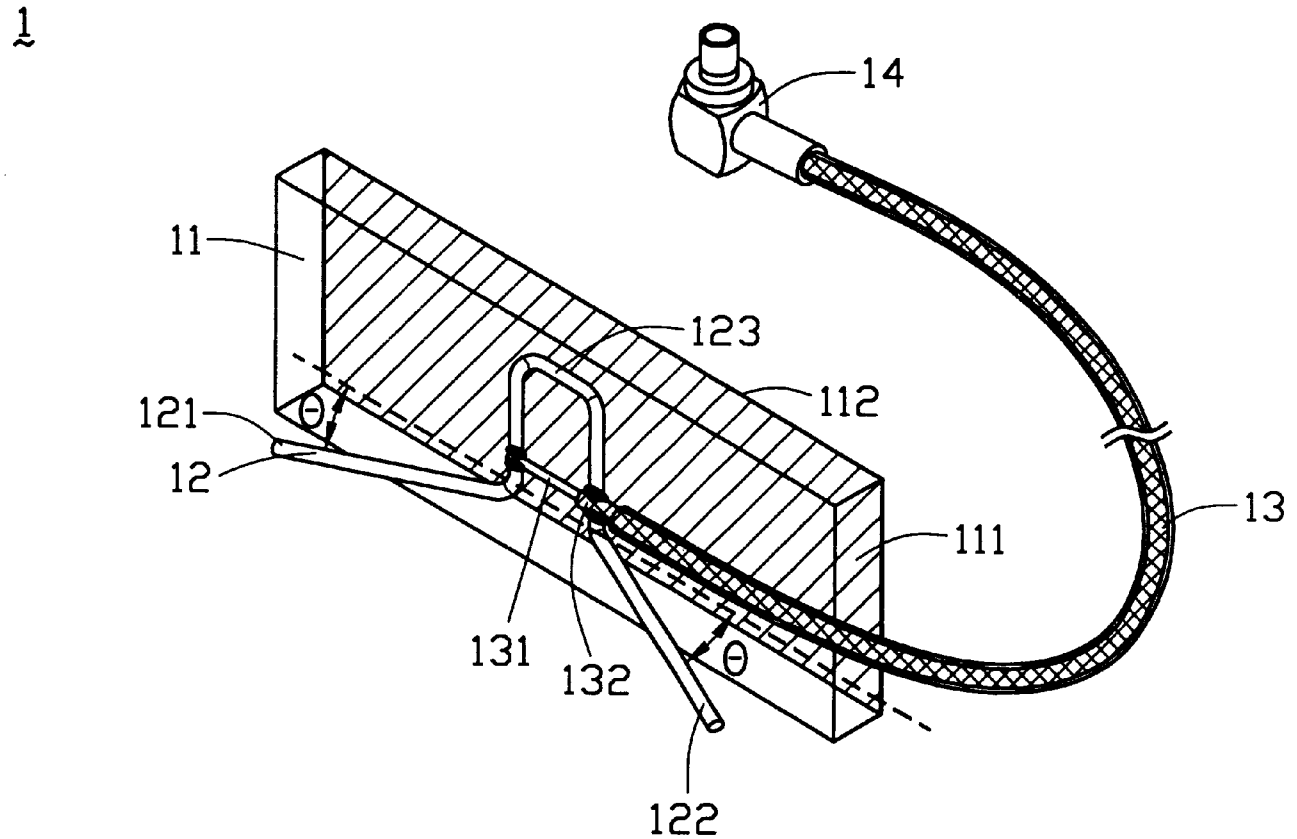
FIG. 1 shows a perspective view of an inverted-F dipole antenna in accordance with an exemplar embodiment of the present invention.

Reference will now be made to the drawing figures to describe the present invention in detail.

Referring to FIG. 1, an inverted-F dipole antenna 1 in accordance with the present invention comprises an antenna base 11, an antenna body 12 mounted on the antenna base 11, a connector 14 providing an electrical interface to an RF circuitry (not shown) and a cable 13 connecting the antenna body 12 with the connector 14.

Figure 2:
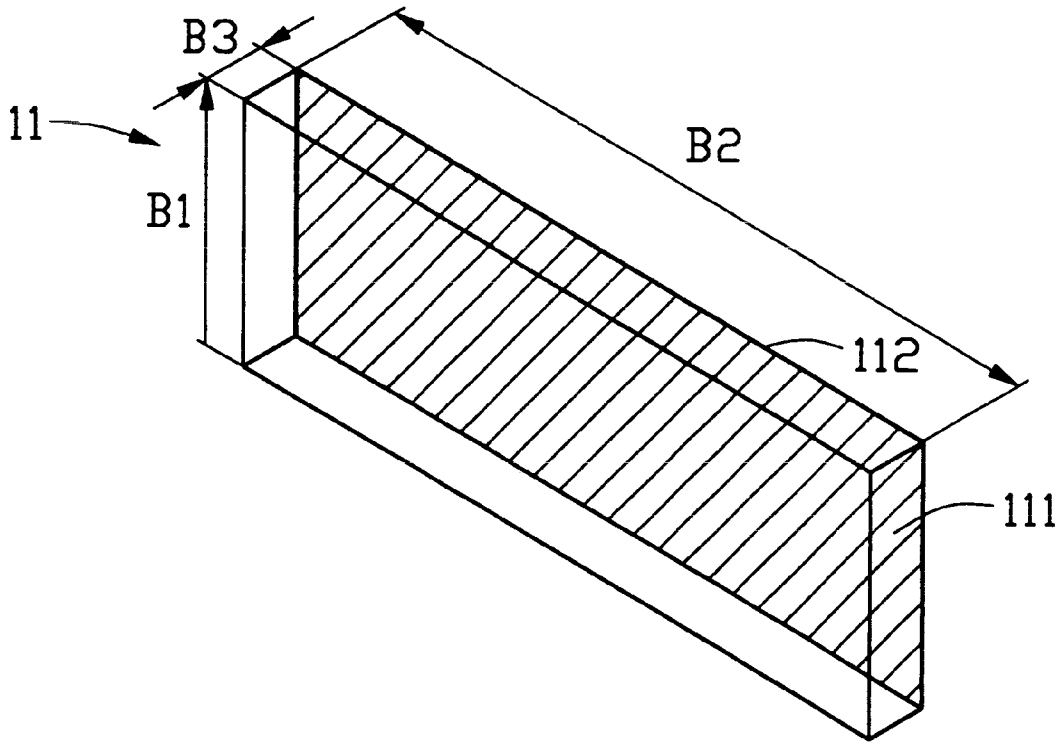
FIG. 2 shows an antenna base of the antenna of FIG. 1.

Particularly referring to FIG. 2, the antenna base 11 includes a rectangular insulative board 111 and a metal sheet 112 attached to one surface of the insulative board 111.

Figure 3:
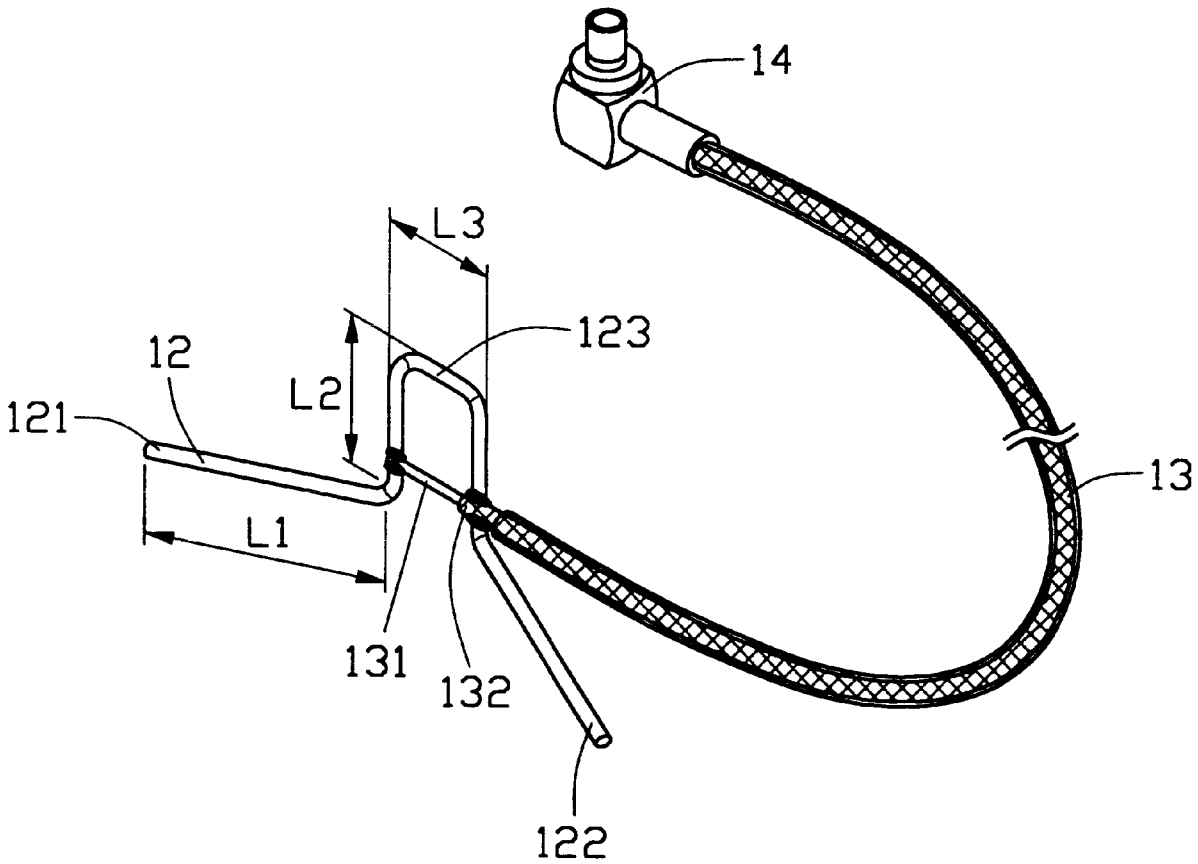
FIG. 3 shows the antenna of FIG. 1 without the antenna base.

Particularly referring to FIG. 3, the antenna body 12 is formed of a conductive metal wire and includes a U-shaped portion 123, and a first arm 121 and a second arm 122 respectively extending substantially opposite to each other from opposite extreme ends of the U-shaped portion 123. In this embodiment, the cable 13 serves as RF feeder of the antenna body 12 and is a coaxial cable. The cable 13 has an inner core wire 131 soldered to one end of the U-shaped portion 123 proximate the first arm 121, and an outer shield 132 soldered to the other end of the U-shaped portion 123 proximate the second arm 122. The first arm 121 is the radiation device of the inverted-F dipole antenna 1.

Figure 4:
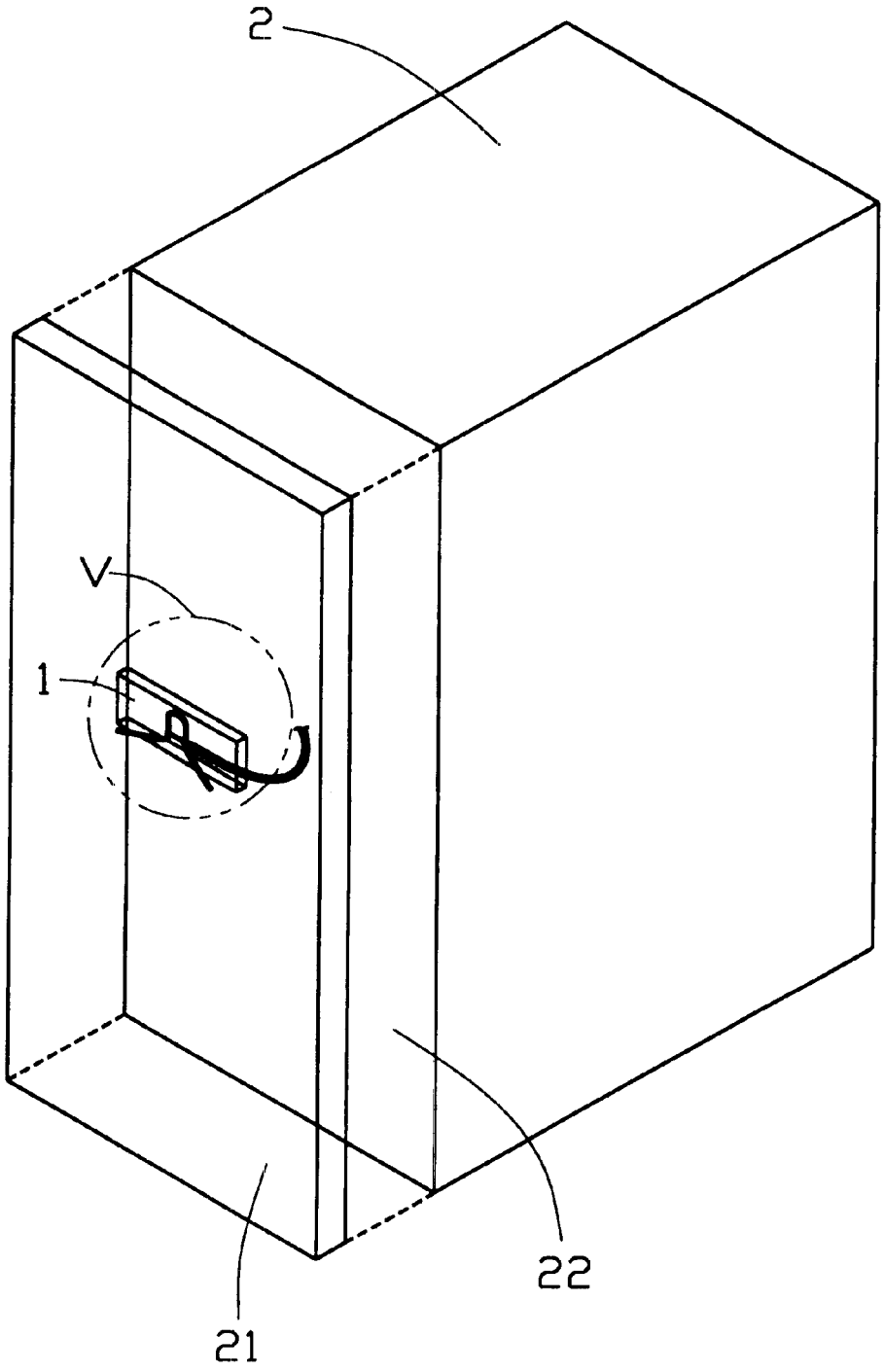
FIG. 4 shows an inverted-F dipole antenna module of the present invention assembled in a desktop computer.
Figure 5:
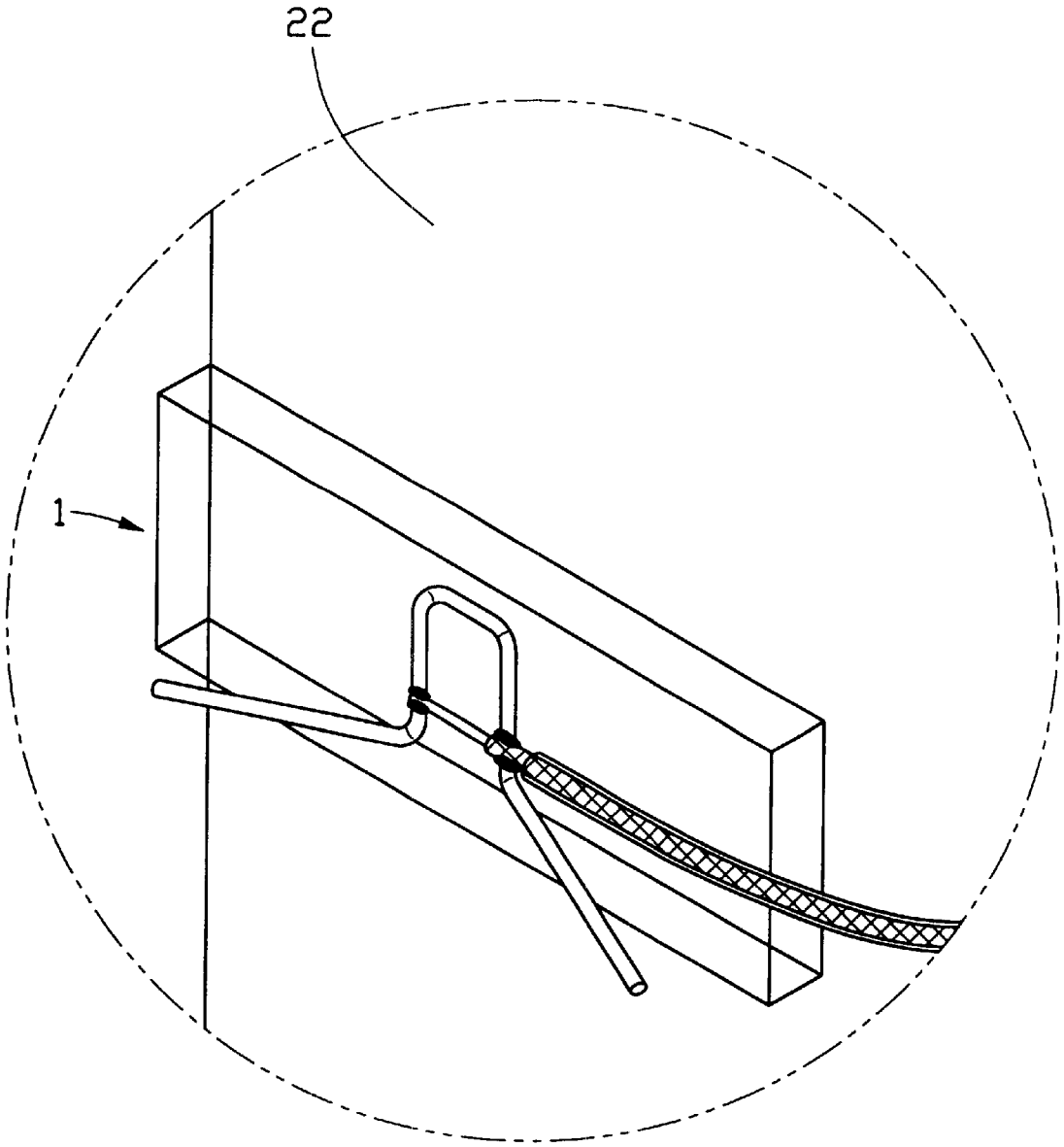
FIG. 5 is a partial, enlarged view of the circled portion labeled V in FIG. 4.

In assembly, referring to FIGS. 1, 4 and 5, after the cable 13 is attached between the connector 14 and the antenna body 12, the antenna body 12 is fixed on the antenna base 11. The U-shaped portion 123 is attached to a second surface of the insulative board 111 opposite to the one surface to which the metal sheet 112 is attached. The first and second arms 121, 122 extend horizontally in two substantially opposite directions, pointing away from the insulative board 111, each forming a same angle 0 with the insulative board 111. The inverted-F dipole antenna 1 is mounted on an enclosure 22 of a desktop computer 2 behind a plastic cover 21 of the desktop computer 2, with the metal sheet 112 being in electrical contact with a front surface (not labeled) of the enclosure 22.

Referring to FIG. 5, the enclosure 22 is made of a conductive material and serves as a reflective surface for the electromagnetic wave radiated by the antenna 1. Even if a portion of the antenna base 11 extends out of the enclosure 22, the metal sheet 112 assists the enclosure 22 to perform as a reflective surface, thereby assuring normal performance of the antenna 1 and making mounting easier. When the inverted-F dipole antenna 1 is operated in the ISM (Industry, Science, Medicine) frequency band of 2.4~2.5 GHz, the reflection loss thereof is more than 10 dB and the Voltage Standing Wave Ratio (VSWR) is less than 2.0, allowing the desktop computer 2 to operate properly.

In this embodiment, dimensions of the antenna base 11 are B1 X B2 X B3, wherein the values of B1, B2 and B3 are 20 mm, 60 mm and 4 mm, respectively. The first and second arms 121, 122 respectively have a length L1 of 25 mm. The U-shaped portion has a length L2 of 13 mm and a width L3 of 5 mm. The angle θ between the first arm 121 and the antenna base 11, and between the second arm 122 and the antenna base 11 is 20 degrees. Under these conditions, the experimental data of FIG. 6 was obtained when the inverted-F dipole antenna 1 was mounted on a desktop computer 2.

Figure 6:
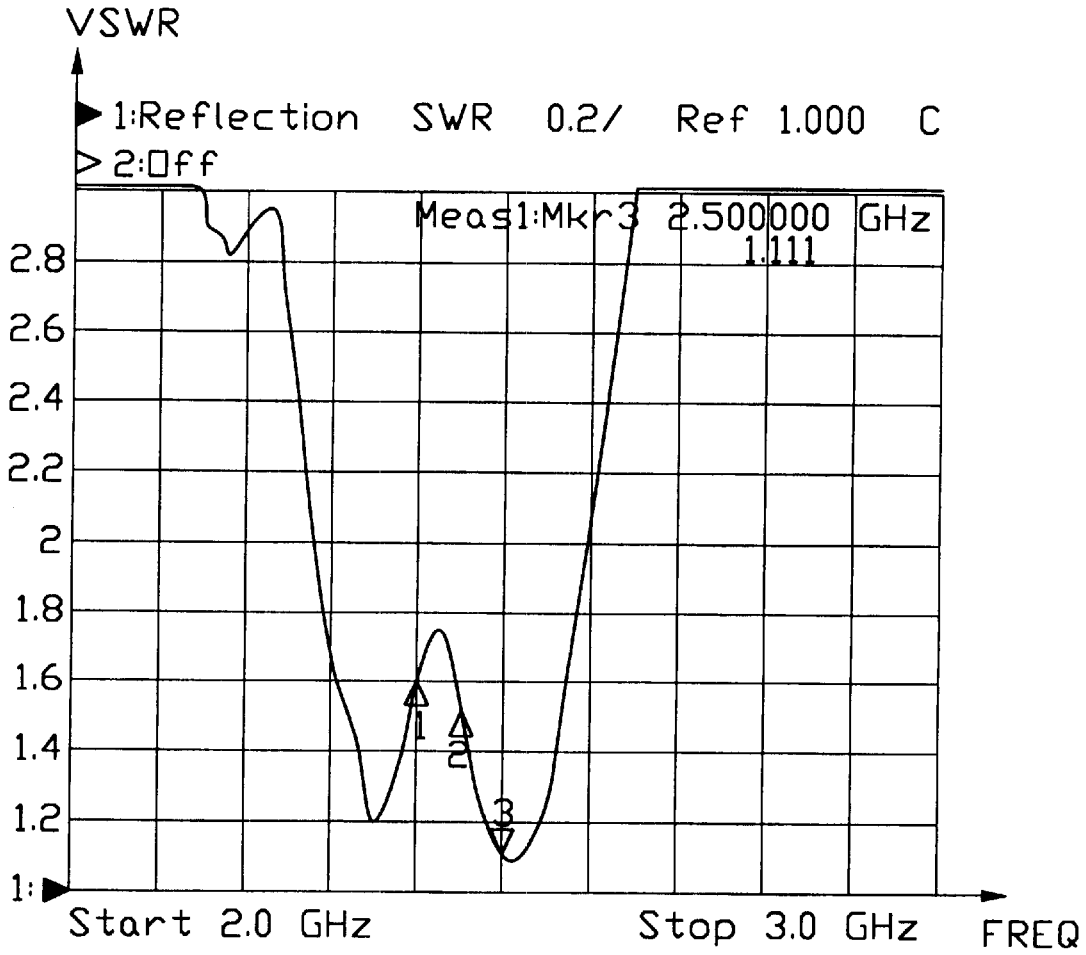
FIG. 6 is a graph of experimental data obtained for the inverted-F dipole antenna of FIG. 1, disclosing Voltage Standing Wave Ratio (VSWR) varying with frequency.
Figure 7:
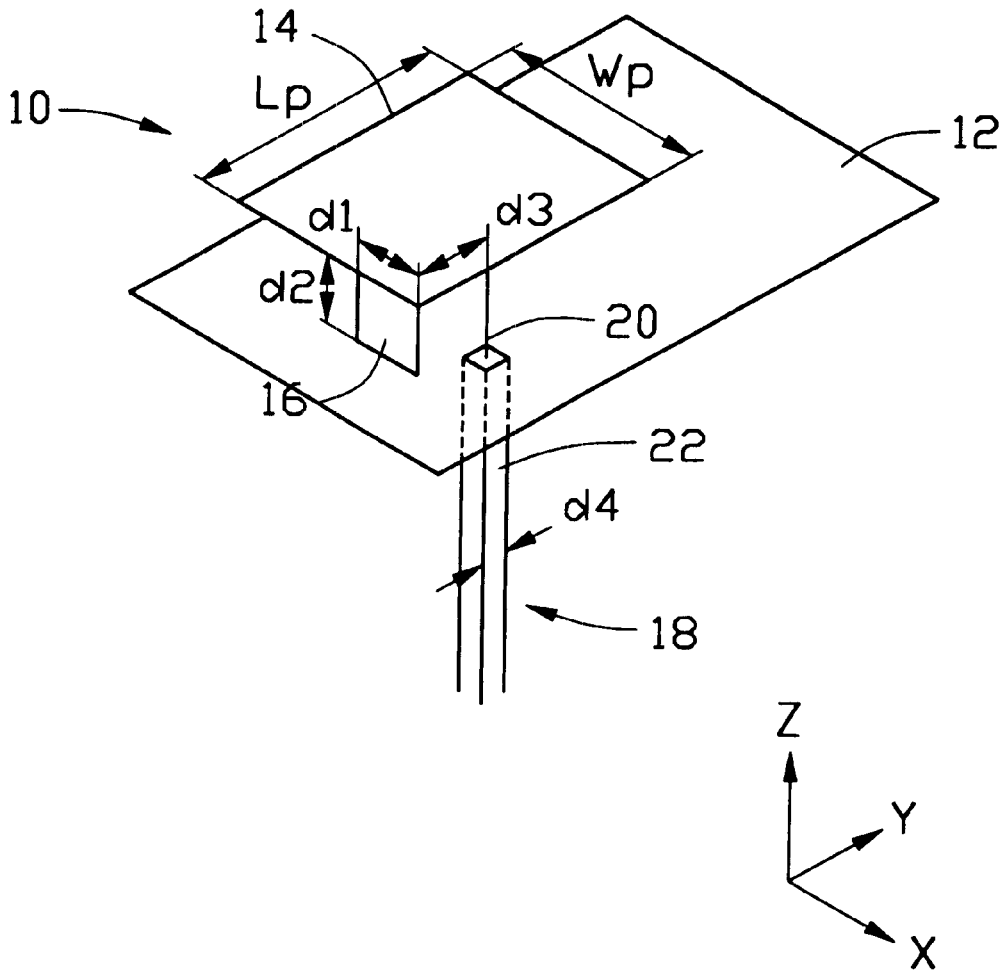
FIG. 7 (PRIOR ART)
FIG. 7 shows a planar inverted-F antenna (PIFA) in accordance with the prior art.

As is shown in FIG. 6, the VSWR of the inverted-F dipole antenna 1 is less than 2.0 in the frequency band 2.4~2.5 GHz.

The experimental data shows that the inverted-F dipole antenna 1 of the present invention can be used with various wireless communication protocols, such as Bluetooth and Wireless LAN. Additionally, an inverted-F dipole antenna 1 of the present invention saves space occupied in an electronic device and is more easily assembled than the prior art planar inverted-F antenna. Understandably, the inverted-F dipole antenna 1 of the invention owns the required electrical characters of the conventional planar inverted-F antenna, i.e., being able to perform 50Ω between the connection points of the inner signal conductor and the outer ground conductor in the frequency band 2.4~2.5 GHz, while without the clumsy/bumpy contour of the traditional inverted-F antenna and instead with essentially the delicate configuration as the traditional dipole antenna which basically does not meet the aforementioned electrical characters.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An inverted-F dipole antenna for an electronic device, comprising:

an antenna body including a first and second metal arms and a flexible conductor connecting the first and second arms;

an antenna base including an insulative board and a metal sheet attached to one surface of the board;

a connector for providing an electrical interface to an RF circuitry; and a cable connecting the antenna body with the connector;

wherein the antenna body is mounted on the antenna base with the flexible conductor being attached to a second surface of the board opposite to the one surface on which the metal sheet is attached.

2. The inverted-F dipole antenna as claimed in claim 1, wherein the cable is a coaxial cable serving as a feeder line of the antenna, and comprises an inner core wire soldered to one end of the flexible conductor proximate the first arm and an outer shield soldered to the other end of the flexible conductor proximate the other arm.

3. The inverted-F dipole antenna as claimed in claim 1, wherein the first metal arm of the antenna body acts as the radiation device of the antenna.

4. The inverted-F dipole antenna as claimed in claim 1, wherein the flexible conductor of the antenna body is U-shaped.

5. The inverted-F dipole antenna as claimed in claim 1, wherein the first and second arms extend horizontally in substantially opposite directions and both form a same angle with the board.

6. The inverted-F dipole antenna as claimed in claim 1, wherein the inverted-F dipole antenna is mounted on an enclosure of a desktop computer behind a plastic cover of the desktop computer, and the metal sheet of the antenna base is attached to the front surface of the enclosure.

7. The inverted-F dipole antenna as claimed in claim 6, wherein the enclosure is made of a conductive material and serves as a reflective surface for electromagnetic waves radiated by the antenna.

8. The inverted-F dipole antenna as claimed in claim 1, wherein the inverted-F dipole antenna operates in a frequency band of 2.4 GHz to 2.5 GHz.

9. An antenna assembly comprising:

a metallic antenna defining a body with two arms extending outwardly and laterally in generally opposite directions, and with a connection portion disposed between said two arms;

a cable including an inner signal conductor and an outer grounding conductor connected to the connection portion proximate the two arms, respectively; and a connector positioned at a distal end of said cable away from the antenna; wherein the connection portion performs a specific electrical resistance between the joint points of the inner signal conductor and the outer grounding conductor during high frequency transmission; and wherein said antenna is attached to one face of a base having a metallic sheet on the other opposite face.

10. The assembly as claimed in claim 9, wherein said antenna is attached to the base, and said two arms extend away from said base with angles, respectively.

* * * * *